US007073540B2

(12) United States Patent
Zorini

(10) Patent No.: US 7,073,540 B2
(45) Date of Patent: Jul. 11, 2006

(54) NEEDLE LOOM WITH AUTOMATIC CHANGE OF THE WEFT THREAD

(76) Inventor: Luigi Omodeo Zorini, Via Dei Mille, 71, 27024 Cilavegna (Pavia) (IT)

( * ) Notice: Subject to any disclaimer, the term of this patent is extended or adjusted under 35 U.S.C. 154(b) by 0 days.

(21) Appl. No.: 11/093,866

(22) Filed: Mar. 30, 2005

(65) Prior Publication Data

US 2005/0284186 A1 Dec. 29, 2005

(30) Foreign Application Priority Data

Jun. 25, 2004 (EP) ..... 04425462

(51) Int. Cl.
*D03D 47/00* (2006.01)
*D04B 25/02* (2006.01)

(52) U.S. Cl. ..... 139/449; 139/429; 139/440; 139/441; 139/442; 139/11; 139/116.1; 66/81; 66/204; 66/82 A

(58) Field of Classification Search ..... 139/429, 139/440–442, 449, 11, 116.1; 66/81, 204, 66/82 A See application file for complete search history.

(56) References Cited

U.S. PATENT DOCUMENTS 3,439,715 A * 4/1969 Yves ..... 139/453
3,519,029 A * 7/1970 Villa et al. ..... 139/431
4,841,750 A * 6/1989 Zorini ..... 66/204
6,112,775 A * 9/2000 Hossli et al. ..... 139/383 R
6,145,176 A * 11/2000 Egnaczak et al. ..... 28/107
6,381,818 B1 * 5/2002 Freeman et al. ..... 28/107
6,962,172 B1 * 11/2005 Zorini et al. ..... 139/429

FOREIGN PATENT DOCUMENTS

| | | |
|---|---|---|
| EP | 0 896 075 A2 | 2/1999 |
| EP | 0 896 075 A3 | 6/1999 |
| EP | 1 353 000 A1 | 10/2003 |
| GB | 1 424 301 | 2/1976 |
| GB | 2 119 414 A | 11/1983 |
| GB | 2 146 665 A | 4/1985 |
| JP | 09 217248 | 8/1997 |

* cited by examiner

*Primary Examiner*—John J. Calvert
*Assistant Examiner*—Robert H Muromoto
(74) *Attorney, Agent, or Firm*—Pearne & Gordon LLP

(57) ABSTRACT

A needle loom comprises a supporting structure (2), at least one forming head (3) of a textile product (P) installed on the supporting structure (2), at least two heddle frames (6) capable of intercepting a plurality of warp threads (O), at least one sickle (9) to bring at least two weft threads (T) transversely between the warp threads (O), at least two movable guides (11) adapted each to intercept one of the weft threads (T), actuator means (13) to move the movable guides (11) and change the weft threads (T) carried by the sickle (9), at least one needle (18), to temporarily retain at least one of said at least two weft threads (T) carried by the sickle (9), and a reed (20) to compact the weft threads (T) against the already formed textile product. The actuator means (13) comprises at least two electric motors (21), connected each with a respective movable guide (11), to move each guide in a manner independent of the others.

27 Claims, 4 Drawing Sheets

22
21
32
24
48
41
25
55
53
49
51
54
10
47
1
2
23
31
11b
27
"Da"
"T"
39
12
20
30a
46b
38
11
11a
3
30
46
46a
30b
37
36
28
34b
34
34a
33b
45
40
44
33
33a
35
42
43
34c

NEEDLE LOOM WITH AUTOMATIC CHANGE OF THE WEFT THREAD

FIELD AND BACKGROUND OF THE INVENTION

The present invention relates to a needle loom with an automatic change of the weft thread.

In textile machines, fabric formation takes place through mutual interlacing of a plurality of warp and weft threads suitably engaged by respective weaving members.

It is known that the textile machines called needle looms comprise one or more forming heads designed to form the textile product at which interlacing occurs between the warp threads coming from respective beams installed on a rack called "creel", and the weft threads unwound from respective bobbins mounted on a creel dedicated thereto and fed from suitable devices. The needle looms are used to manufacture textile products of an indefinite length but having reduced widths, in the order of few centimeters, such as ribbons, tapes or laces, shoulder straps, etc.

Each forming head substantially comprises a bearing plate defining the forming plane of the textile product, at least one pair of heddle frames designed to alternately raise and lower the warp threads fed to the bearing plate, a sickle bringing one or more weft threads between the warp threads in a direction transverse to the warp threads themselves, a needle designed to retain the weft threads before the latter are harnessed between the warp threads by effect of the heddle frame motion, and a reed that, after each passage of the sickle, compacts the weft threads on the already formed textile product. Suitable means disposed downstream of the forming station keep the textile product under tension and allow the same to come out of the loom.

Known in the art are needle looms capable of feeding two or more weft threads, of different colors or materials, to the sickle, and to select which of said threads must be included in the fabric at each passage of the sickle itself. Needle looms of this type allow ribbons with multi-colored transverse bands to be manufactured, for example.

For the purpose, the looms of the known art are provided with a particular guide device that is placed upstream of the sickle and enables each of the weft threads to be moved vertically between an active position at which it is hooked by the sickle, and a passive position at which the sickle is not able to intercept said weft thread.

This device is located close to the bearing plate and the reed and comprises as many movable guide elements as the weft threads. Each guide element is provided with an eye through which a weft thread passes before reaching the sickle. Each guide element is vertically movable usually between a lower position, an intermediate position and un upper position. The sickle is provided with a hook in which the weft thread engages when the latter is brought to the intermediate position by a movable guide element while the other elements are at one of the end positions.

Movement of the guide elements in accordance with the known art is obtained through complicated motion-transmitting mechanisms connected with the main drive shaft of the needle loom and capable of converting the periodic motion of the shaft into distinct movements that are however correlated with the individual guide elements.

The motion-transmitting mechanisms of known type are formed of mechanical transmissions and/or magnetic actuators capable of hooking or releasing one of the movable guide elements, based on the angular work phase of the drive shaft.

As a consequence of the above, in most of the known needle looms, the law of motion of the movable guide elements cannot be varied, unless the whole motion-transmitting mechanism is fully designed again.

Also known are needle looms enabling movement of the guide elements to be changed; but in this case the motion-transmitting mechanisms must be disadvantageously physically modified through replacement of parts of them or mounting of said parts according to different configurations for example, in order to pass from a pattern to another.

In any case, all needle looms of known type do not enable the law of motion of the guide elements to be changed and therefore the distribution of the weft threads in the fabric to be modified during working.

SUMMARY OF THE INVENTION

Accordingly, the present invention aims at eliminating the above stated drawbacks by proposing a needle loom with an automatic change of the weft thread that is much more versatile than in known looms.

In particular, it is an aim of the present invention to propose a needle loom enabling the law of motion of the guide elements of the weft threads to be easily changed in order to vary the distribution of the weft threads in the fabric in the same way and therefore the type of fabric thus produced.

Another aim of the present invention is to devise a needle loom with automatic change of the weft threads in which the actuating means for the guide elements are of simple and reliable construction.

The foregoing and further aims are substantially achieved by a needle loom with automatic change of the weft thread comprising a supporting structure; at least one forming head of a textile product installed on the supporting structure; said head having a bearing plate for formation of the textile product, at least two heddle frames to intercept a plurality of warp threads fed to the bearing plate, at least one sickle to bring at least two weft threads transversely between the warp threads, at least two movable guides, each adapted to guide one of said at least two weft threads fed to the sickle, actuator means to move said at least two movable guides and change the weft threads carried by the sickle, at least one needle to temporarily retain at least one of said at least two weft threads carried by the sickle, and a reed movable between a disengagement position and a compacting position, to compact the weft threads against the already formed textile product; wherein the actuator means to move said at least two movable guides comprises at least two electric motors connected each with a respective movable guide, to move each guide in a manner independent of the others.

BRIEF DESCRIPTION OF THE DRAWINGS

The description of a preferred but not exclusive embodiment of a needle loom with automatic change of the weft thread is now given by way of non-limiting example with reference to the accompanying drawings, in which.

DESCRIPTION OF THE PREFERRED EMBODIMENT

Figure 1:
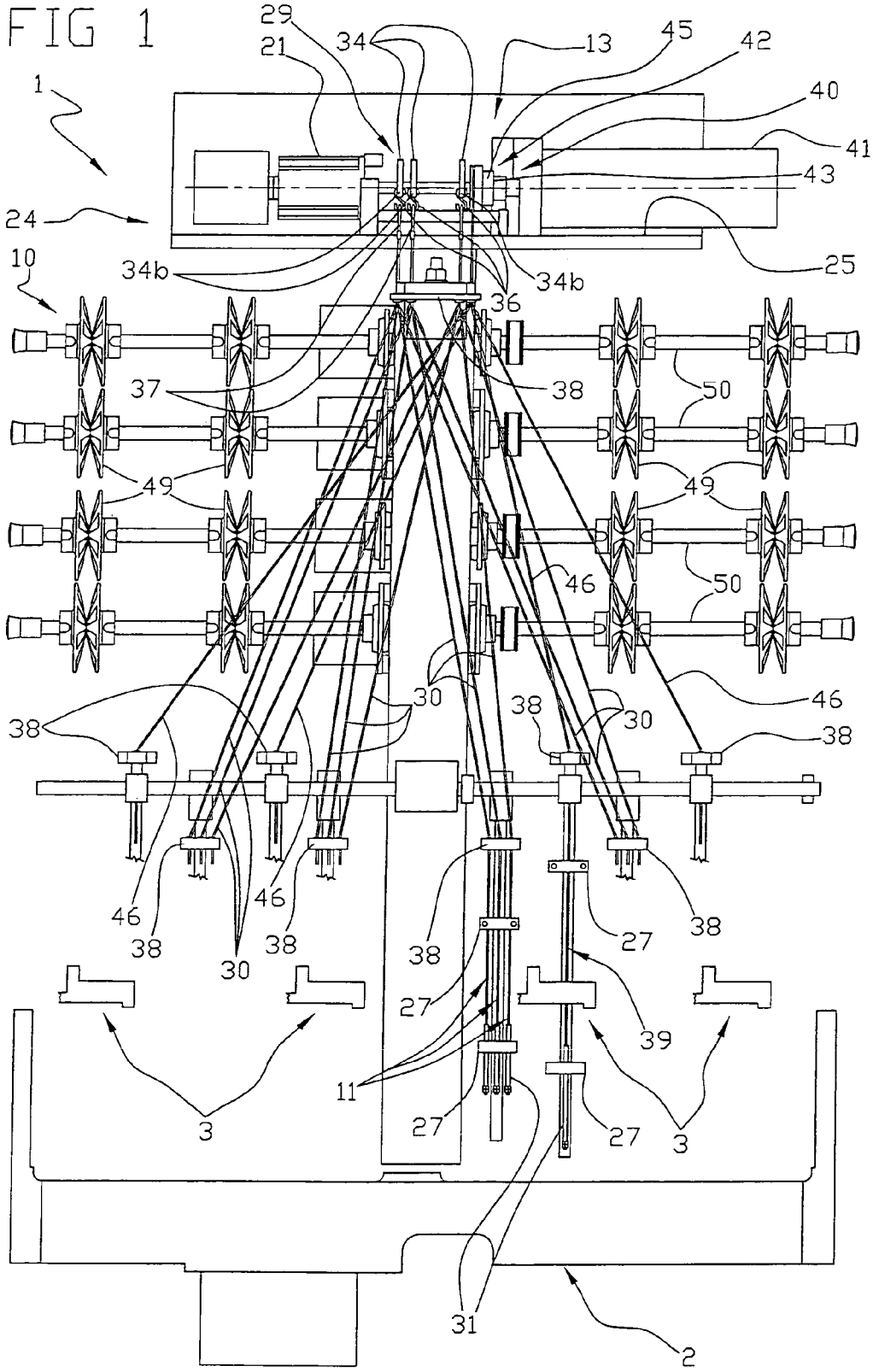
FIG. 1 is a diagrammatic elevation front view of a needle loom with automatic change of the weft thread in accordance with the present invention, in which some parts are removed for a better view of others.

With reference to the drawings, a needle loom with automatic change of the weft thread in accordance with the present invention has been generally identified with reference numeral 1.

The needle loom 1 comprises a supporting structure 2 on which at least one forming head 3 for a textile product "P" (shown in detail in FIG. 4) is mounted. In the accompanying drawings, loom 1 has four forming heads 3 disposed in side by side relationship with each other along a predetermined axis "X" (FIG. 3), said heads being able to simultaneously produce the same number of textile products "P".

Figure 4:
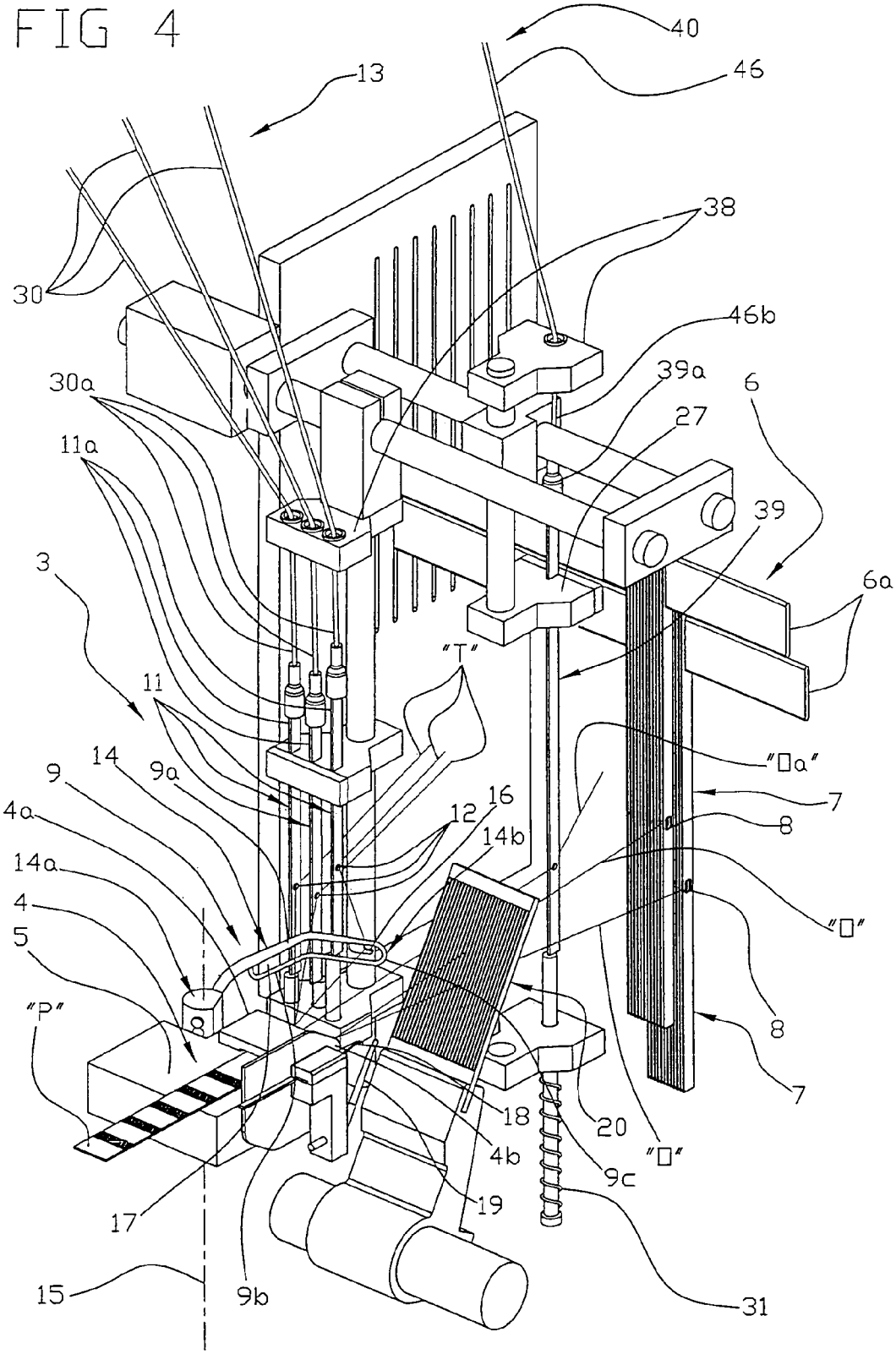
FIG. 4 is a perspective view to an enlarged scale of a detail shown in FIGS. 1, 2 and 3.

As better shown in FIG. 4, according to one pattern of known type, the forming head 3 comprises a bearing plate 4 having a predetermined forming plane 5 on which the textile product "P" rests.

Upstream of the bearing plate 4, the forming head 3 has at least two heddle frames 6, preferably a plurality of heddle frames 6.

Figure 2:
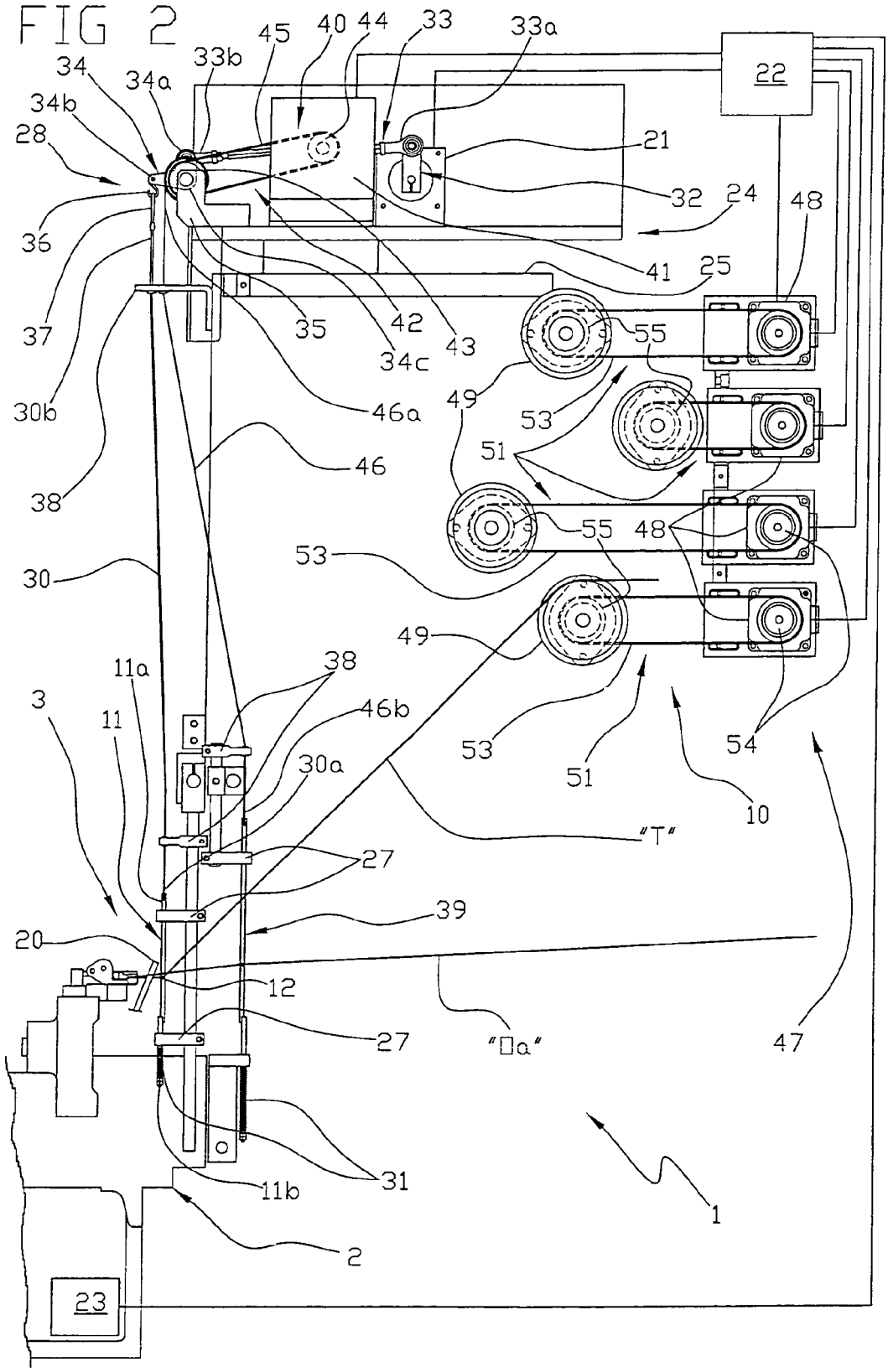
FIG. 2 is a diagrammatic elevation side view of the loom in FIG. 1.
Figure 3:
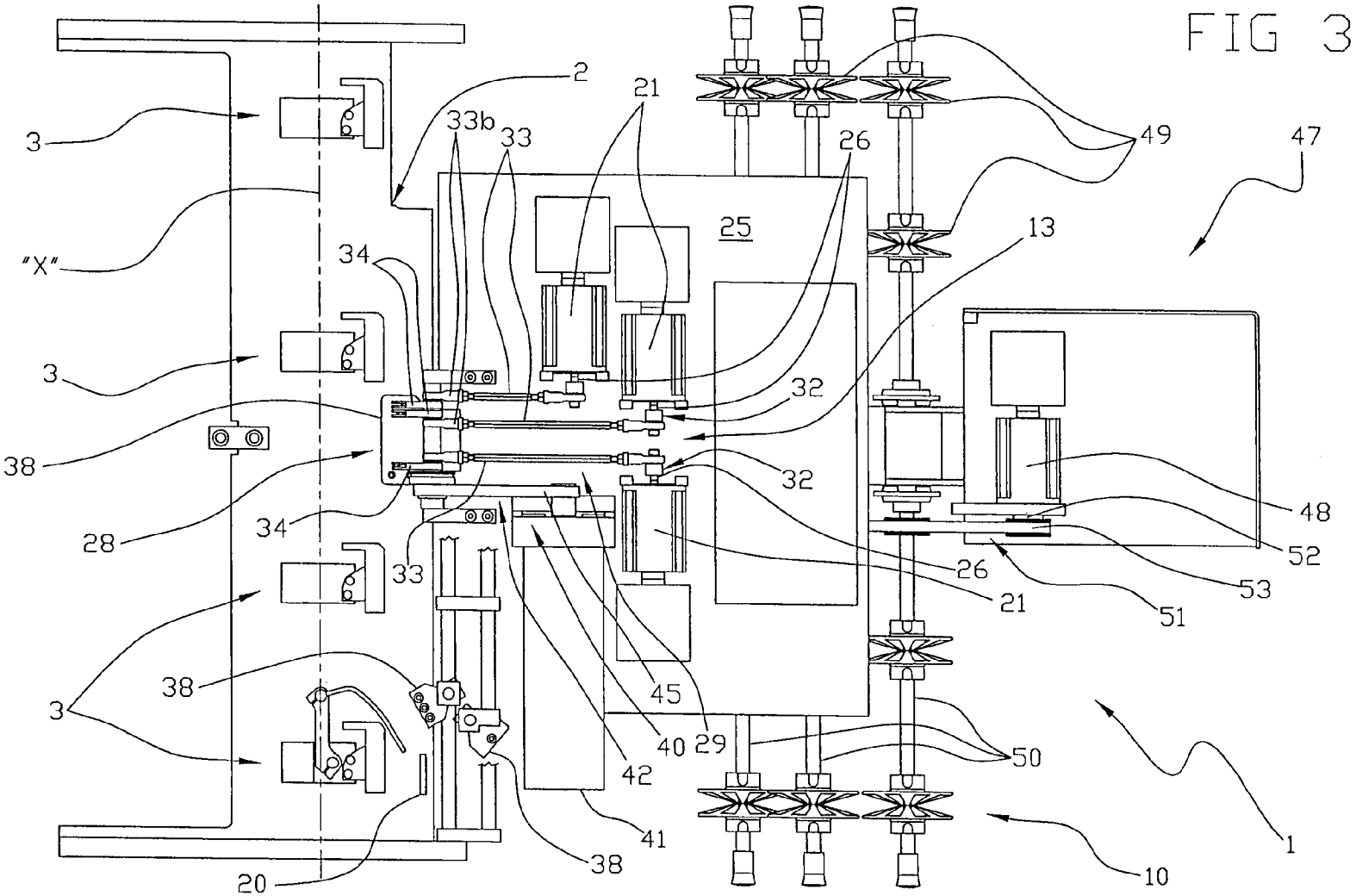
FIG. 3 is a diagrammatic view from top of the frame in FIG. 1.

For the sake of clarity, in FIGS. 1, 2 and 3 the heddle frames 6 have not been illustrated and the forming heads 3 have been shown only diagrammatically.

The heddle frame 6 is an element capable of alternately raising and lowering the warp threads "O" engaged by it while said threads are being fed to the bearing plate 4. Each heddle frame 6 comprises a plurality of heddles 7 each provided with an eye 8 through which a warp thread "O" passes. Heddles 7 are mounted on a pair of heddle slide bars (FIG. 4) reciprocated along a direction perpendicular to the forming plane 5. Each heddle frame 6 engages a set of warp threads "O", only two of which are represented in FIG. 4, and is usually moved between two or three operating positions.

The heddle frames 6 can be guided by a Glider chain or a cam chain connected with a main drive shaft of loom 1 or by electromechanical actuators operated in accordance with preset programs.

The warp threads "O" come from respective beams of known type and not shown, mounted on a rack called creel for example, and are fed by suitable means to the bearing plate 4 through the heddle frames 6. In particular, the warp threads "O" pass through the eyes 8 of the heddle frame heddles 7 and converge towards a forming plane 5 where they are interlaced with at least one weft thread "T" to form the textile product "P (FIG. 4).

In more detail, the warp threads "O" intercepted by a single heddle frame 6 lie in the same plane and the planes identified by the warp threads "O" of the different heddle frames 6 intersect at the bearing plate 4.

Downstream of the bearing plate 4, the loom 1 has suitable means of known type, not shown, keeping the textile product P" already formed and the warp threads "O" coming from the heddle frames tensioned, thus enabling exit of same.

The head 3 further comprises at least one sickle bringing at least two weft threads "T" transversely of the warp threads "O", in an alternated manner.

Each of the weft threads "T" is unwound from a respective bobbin, mounted on a creel and is advantageously fed to the sickle 9 through feeding means 10 (FIG. 2) and through a respective movable guide 11 disposed close to the bearing plate 4 (FIGS. 2 and 4).

Each of the movable guides 11 preferably has a structure similar to the heddle of a heddle frame 6. It consists of a vertical rod provided with an eye 12 inside which a weft thread "T" passes before reaching sickle 9 (FIG. 4).

Each of the movable guides 11 is moved along a vertical direction with a reciprocating motion preferably offset with respect to the motion of the other guides 11, by actuator means 13, shown in FIGS. 1, 2, 3 and only partly in FIG. 4, so as to vary the height of eyes 12 guiding the weft threads "T" and the location in height of the weft threads "T" themselves.

Sickle 9 has a U-shaped arm 14 with a first end 14*a* hinged around an axis 15 perpendicular to the predetermined forming plane 5 and a second end 14*b* provided with a hook 16 preferably a dovetail hook, capable of intercepting one of the weft threads "T" to bring it in engagement with the warp threads "O" close to the bearing plate 4.

According to a pattern of known type, sickle 9 carries out an alternated rotatory motion in the form of an arc of a circle so that hook 16 cyclically moves close to and away from the warp threads "O".

In particular, hook 16 is movable between a first position at which it lies in side by side relationship with a first side end 4*a* of the bearing plate 4, and a second position, at which it lies in side by side relationship with a second side end 4*b* of the bearing plate 4.

The hook 16 of sickle 9 intercepts and brings to the second side end 4*b* of the bearing plate 4, the weft thread "T" positioned by the respective movable guide 11 at a predetermined location in height, while the other weft threads "T" having a higher or lower position are not intercepted.

To prevent the weft threads "T" that are not engaged by hook 16 from interfering with other parts of loom 1 or, given the concerned velocities, from starting vibrating, thus making it impossible for sickle 9 to intercept them in a subsequent work cycle, sickle 9 preferably has two superposed arms 9*a*, 9*b* connected close to the second end 14*b* by an arched segment 9*c*. The two arms 9*a*, 9*b* delimit a slit 17 through which all weft threads "T" pass, irrespective of whether they are intercepted or not by hook 16. In the embodiment herein illustrated, the hook 16 is rigidly connected with the upper arm 9*a* and extends within the slit 17.

At the second side end 4*b* of the bearing plate 4, the head 3 has at least one movable needle 18 the function of which is to temporarily retain on its end, the weft thread "T" brought by sickle 9 to the second position, until interlacing of this weft thread "T" with the warp threads "O". Needle 18 moves relative to the bearing plate 4 between a retracted position, at the first position of sickle 9, and a moved forward position, corresponding to the second position of sickle 9. A charging device 19 disposed in side by side relationship with needle 18 is used to charge the weft thread "T" on the end of said needle 18.

The forming head 3 finally comprises a reed 20 the dual function of which is to keep the warp threads "O" separated from each other and to tighten the weft threads "T" against the already formed textile product "P", preferably after each passage of sickle 17.

The reed 20 is installed between the bearing plate 4 and the heddle frames 6 and has a frame of parallel vertical lamellae or rods fastened to a rigid framework. The reed 20 is movable between a disengagement position, at which it lies spaced apart from the bearing plate 4 and the textile product already formed "P", and a compacting position at which it lies close to the bearing plate 4 to compact the weft thread or threads "T".

Advantageously and in a different manner from the looms of the known art, the actuator means 13 designed to move the movable guides 11 of the weft threads "T" comprise the same number of electric motors 21 as the number of movable guides 11 present in a single forming head 3 (FIGS. 1, 2 and 3). Each electric motor 21, preferably of the stepping type or brushless, is connected with a respective one of the movable guides 11 to displace it, in a manner independent of the others.

Preferably, as shown in FIG. 1, each of the electric motors 21 is connected with the homologous movable guides 11 of all heads 3.

By the term "homologous guides" it is intended the guides 11 of the different heads 3 that are located in the same relative position with respect to the remaining movable guides 11 of a single head 3 and that carry out the same movement sequence.

In this way, all heads 3 of a single loom 1 driven by a single group of electric motors 21 work in parallel to produce identical articles of manufacture.

According to alternative embodiments not shown, also falling within the scope of the present invention is a loom 1 provided with electric motors 21 specifically dedicated to the movable guides 11 of each individual head 3, therefore capable of simultaneously producing different articles of manufacture.

The electric motors 21 are operatively connected with a programmable control unit 22 (diagrammatically shown in FIG. 2), preferably a microprocessor, capable of controlling displacement of each movable guide 11 based on specific work programs set by an operator.

Unit 22 is further connected with sensor means 23, only diagrammatically shown, detecting and transmitting to the unit 22 itself, at least one parameter indicating the work step of loom 1, which performs the function of reference signal for such a unit 22. Preferably, the sensor means 23 consists of an encoder mounted close to the main drive shaft for example, to detect the angular position of the shaft and the exact operating step of loom 1, at each instant. The encoder 23 enables the angular position of the main drive shaft at which intervention of the electric motors 21 and displacement of the movable guides 11 take place to be set, via software.

The electric motors 21 are installed on an upper portion 24 of the support structure 2, over the forming heads 3. In particular, the upper portion 24 delimits a horizontal plane 25 on which motors 21 rest and are fastened, each having its own small shaft 26 oriented parallel to the axis "X" of mutual alignment of the forming heads 3 (FIG. 3).

In the embodiment shown, the loom 1 has four forming heads 3, each provided with three movable guides 11 that are disposed in mutual side by side relationship and are vertically slidable within fixed supports 27 mounted on the supporting structure 2 (FIGS. 1, 2 and 4).

Installed in the horizontal plane 25 are three electric motors 21 dedicated to the movable guides 11.

Motion-transmitting means 28 is interposed between each electric motor 21 and the respective movable guide 11 or the respective homologous movable guides 11.

In more detail in terms of construction, the motion-transmitting means 28 comprises an intermediate kinematic mechanism 29 connected with the electric motor 21, and a flexible element 30.

The flexible element 30, in the form of a cord, has a first end 30*a* connected with a first end 11*a* of the movable guide 11 and a second end 30*b* connected with the intermediate kinematic mechanism. A return spring 31 connects a second end 11*b* of the movable guide 11, opposite to the first one, with the supporting structure 2.

The intermediate kinematic mechanism 29 is made up of a crank, a connecting-rod 33 and a rocker arm 34 mounted on the horizontal plane 25. In FIG. 2 one of the electric motors 21 has not been shown for a better view of this structure. The crank 32 is fitted on the small shaft 26 of the electric motor 21, the connecting-rod 33 has a first end 33*a* pivotally mounted on the crank 32 and a second end 33*b* articulated on a first end 34*a* of the rocker arm 34 (FIG. 2).

The rocker arm 34 has a second end 34*b* connected with the second end 30*b* of the flexible element 30 and a third end 34*c* hinged on the upper portion 24 of the supporting structure 2 through a bracket 35.

The second end 34*b* of the rocker arm 34 carries, hinged thereon, a hook 36 engaging an eye 37 formed at the second end 30*b* of the flexible element 30 (FIGS. 2 and 3).

Loom 1 as shown has a plurality of flexible elements 30 associated with each electric motor 21, to connect the rocker arm 34 with all homologous guides 11 of the forming heads 3 (FIG. 1).

The flexible elements 30 are guided to the respective heads 3 through elongated slots formed in suitable guide elements 38 mounted on the supporting structure 2 between the motors 21 and forming heads 3.

In accordance with the preferred and herein illustrated embodiment, loom 1 is further provided with at least one and preferably two auxiliary movable guides 39 that are similar in structure to the movable guides 11 for the weft threads "T" but positioned close to the heddle frames 6, downstream or upstream of the latter with respect to a moving forward direction of the warp threads "O" towards the bearing plate 4. The auxiliary movable guide 39 too is slidable within supports 27 that are rigidly connected with the supporting structure 2.

In accordance with a scheme of known type, the auxiliary guide 39 intercepts an auxiliary warp thread "Oa" that must be moved along a vertical direction in a manner independent of the sets of warp threads "O" engaged by the heddle frames 6. In particular, the auxiliary warp thread "Oa" is used for manufacturing ribbons to be gathered or crumpled up, known by themselves, in which the auxiliary warp thread "Oa" remains superposed on the weft threads "T" over predetermined longitudinal lengths of the ribbon. This configuration allows the final purchaser to gather the ribbon by merely causing sliding of the auxiliary warp thread "Oa" with respect to the rest of the textile product.

During formation of the fabric, the heddle frames 6 are vertically moved between two end positions, an upper and a lower position respectively, to cause crossing of two or more sets of warp threads "O" and interlacing with the weft threads "T" carried by sickle 9.

The auxiliary guide 39 moves independently of the heddle frames 6 and keeps the auxiliary warp thread "Oa" to the upper or lower position for a predetermined number of work beat-ups so that, in the finished product "P", the auxiliary warp thread "Oa" remains superposed on a plurality of weft threads "T" along the predetermined longitudinal ribbon lengths.

Each auxiliary movable guide 39 is moved by actuating means 40 dedicated thereto that, unlike in looms of known type, is defined by an auxiliary electric motor 41. The auxiliary electric motor 41 is connected with the auxiliary guide 39 through an intermediate mechanical driving mechanism 42 similar to the motion-transmitting means 28 interposed between the guides 11 for the weft "T" and the respective motors 21.

In the embodiment herein illustrated and comprising a plurality of forming heads 3 provided each with a single auxiliary guide 39, the auxiliary electric motor 41 is connected with the auxiliary homologous guides of all heads 3 (FIG. 1).

The illustrated embodiment shows the auxiliary electric motor 41 controlling the auxiliary guide 39 for the auxiliary warp thread "Oa", disposed in side by side relationship with the three electric motors 21 dedicated to the guides 11 of the weft threads "T".

The mechanical driving mechanism 42 comprises an idle pulley 43 mounted on bracket 35 and connected with the small shaft 44 of the auxiliary motor 41 through a belt 45. Belt 45 passes over the pulley 43 and the motor small shaft 44 itself (FIG. 2).

Hooked on pulley 43 is a first end 46*a* of a flexible element 46 defined by a cord similar to those used to move the guides 11 of the weft threads "T". The cord 46, at its second end 46*b* opposite to the first end 46*a*, is connected with an upper end 39*a* of the auxiliary movable guide 39. The auxiliary movable guide 39 is further mounted, like the guides 11 of the weft threads "T", on the supporting structure 2 through a return spring 31.

Each cord 46 is guided towards the heads 3 through elongated slots formed in suitable guide elements 38 mounted on the supporting structure 2 between the motor 41 and the forming heads 3.

Rotation of the small shaft 44 of the auxiliary electric motor 41 in both a clockwise and counterclockwise direction causes partial winding/unwinding of the cord 46 on pulley 43 and raising/lowering of the auxiliary guide 39.

As shown in FIG. 2, the auxiliary electric motor 41 too, that can be of the same type as motors 21 for the weft threads "T", is connected with the programmable control unit 22, to control displacement of each auxiliary movable guide based on the work program set by the operator.

One or more auxiliary movable guides 39 moved by respective auxiliary electric motors 41 following the above described scheme can be present on the needle loom 1 also in the absence of the weft changing device or with a weft changing device different from the one described in detail above.

Referring particularly to FIG. 2, the means 10 for feeding the weft threads "T" is positioned upstream of the forming head 3 and the movable guides 11 at a rear region 47 of the supporting structure 2.

Advantageously, the means 10 for feeding the weft threads "T" comprises as many secondary electric motors 48 as the number of movable guides 11 and the weft threads "T" of each head 3. The feeding means 10 further comprises a plurality of pulleys 49 on which the weft threads "T" are engaged. Each pulley 49 is dedicated to a respective movable guide 11.

In the illustrated embodiment that is provided with a plurality of forming heads 3, each of the secondary electric motors 48 is connected with a plurality of homologous pulleys 49 dedicated to the homologous movable guides 11 of all heads 3. The homologous pulleys 49 are carried by a single propeller shaft 50 extending through the supporting structure 2 and lying parallel to the predetermined "X" axis on which the forming heads 3 are disposed in side by side relationship. Shafts 50 are mutually parallel and are driven in rotation by respective secondary electric motors 48. Each shaft 50 belongs to a motion-transmitting member 51 interposed between the secondary electric motor 48 and one of pulleys 49.

The secondary electric motors 48 that can be of the same type as the electric motors 21 dedicated to the movable guides 11 for the weft threads "T", are mounted on the rear portion 47 of the supporting structure 2 with their small shaft 52 oriented horizontally and parallel to the predetermined "X" axis (FIG. 3).

The motion-transmitting member 51 further comprises a belt 53 passing over the small shaft 52 of the respective secondary electric motor 48 and the respective propeller shaft 50. In particular, belt 53 is a drive belt passing over a first cogwheel 54 fitted on the small shaft 52 and on a second cogwheel 55 fitted on the propeller shaft 50.

The secondary electric motors 48 are connected with the programmable control unit 22 operating them in such a manner that the angular velocity of said motors is varied so as to keep the weft threads "T" tensioned during every working step. For the purpose, the secondary motors 48 can be operated for rotation in both ways, even if they usually rotate only in one way.

All movements of the above described elements are electronically controlled by the control unit 22 to enable them to take place in synchronism following the operating diagram hereinafter described.

In use, in a first operating step of the needle loom 1, while two sets of warp threads "O" are held spaced apart by the two heddle frames 6, sickle 9 is in the first position and hook 16 is in side by side relationship with the first side end 4*a* of the bearing plate 4. Needle 18 is retracted and temporarily retains the weft thread "T", the charging device 19 is in the lowered position and reed 20 is in its compacting position.

At this point, the heddle frames 6 moved in opposite ways, cause crossing of the two sets of warp threads "O" and interlacing with the weft "T".

Reed 20 moves to the disengagement position and allows sickle 9 to move to the second position close to the second side end 4*b* of the bearing plate 4.

During this movement, the hook 16 of sickle 9 engages the weft thread "T" that, at that instant, reaches the predetermined location in height for interception and is retained by one of the movable guides 11.

The other weft threads "T" passing in the movable guides 11 positioned to a higher or lower location are not intercepted but are in any case maintained tensioned through slowing down of the angular speed of the secondary motors 48, or even reversal of same.

Simultaneously, needle 18 moves to the advanced position and releases the already interlaced weft thread "T", being ready to retain the weft thread "T" brought again by sickle 9.

Before sickle 9 goes back to the first position, the charging device 19 moves upwards and causes hooking of the weft thread "T" with needle 18 during the return stroke of the latter to the retracted position. Once sickle 9 has gone back to the first position, reed 20 moves to the bearing plate 4 to compact the new weft course.

At this point a new operating cycle for making a subsequent weft course begins.

According to the previously set program, the control unit 22 operates the electric motors 21 to make them move the movable guides 11 and lead the same weft thread or a different weft thread "T" to pass or stand by at the interception location in height during moving forward of sickle 9.

The textile product "P" obtained with the present needle loom is formed of a succession of weft courses consisting of different weft threads "T" interlaced with the warp threads "O". The weft threads "T" utilized can be of different materials or merely of different colours.

Finally, as an alternative to the sickle of the described type both in terms of construction and operation, the loom being the object of the invention can have other types of sickles, known by themselves, that, while working in a slightly different manner from that described in detail above, in any case allow at least two weft threads "T" to be brought transversely between the warp threads "O", in an alternated manner.

The invention achieves important advantages.

The needle loom with automatic change of the weft thread in accordance with the present invention is much more versatile than the looms of the known art.

In fact, the needle loom in reference allows different types of ribbons to be manufactured by mere setting of the unit controlling the guides for the weft threads and the guides for the auxiliary warp threads, without replacement of mechanical parts or mounting of said parts in different configurations being required.

In addition, the needle loom in accordance with the present invention allows the sequence of the weft threads and the position of the auxiliary warp thread to be varied in an automatic manner during working, without stopping the machine.

Furthermore, by adopting electric motors in place of the traditional electromechanical controls on the weft, the work speed of the loom can be increased until about one thousand beat-ups per minute.

Due to the electronic control of the secondary motors, tensioning of the weft threads can be optimized and consequently ribbons of very regular longitudinal edges can be obtained.

Finally, the combined action of the secondary motors on the weft threads and of the tensioning means of the warp threads coming from the heddle frames enables ribbons of varying width to be produced by merely varying the tension of the warp threads and the weft threads in an alternated manner, based on parameters previously set in the control unit.

What is claimed is:

1. A needle loom with automatic change of the weft thread, comprising:

a supporting structure (2);

at least one forming head (3) of a textile product (P) installed on the supporting structure (2); said head (3) having a bearing plate (4) for formation of the textile product (P), at least two heddle frames (6) to intercept a plurality of warp threads (O) fed to the bearing plate (4), at least one sickle (9) to bring at least two weft threads (T) transversely between the warp threads (O), at least two movable guides (11), each adapted to guide one of said at least two weft threads (T) fed to the sickle (9), actuator means (13) to move said at least two movable guides (11) and change the weft threads (T) carried by the sickle (9), at least one needle (18) to temporarily retain at least one of said at least two weft threads (T) carried by the sickle (9), and a reed (20) movable between a disengagement position and a compacting position, to compact the weft threads (T) against the already formed textile product (P);

characterized in that the actuator means (13) to move said at least two movable guides (11) comprises at least two electric motors (21) connected each with a respective movable guide (11), to move each guide (11) in a manner independent of the others.

2. The loom as claimed in claim 1, wherein said loom comprises a plurality of forming heads (3) and each of said electric motors (21) is connected with the homologous movable guides (11) of all heads (3).

3. The loom as claimed in claim 1, wherein each of said electric motors (21) is a stepping motor.

4. The loom as claimed in claim 1, wherein each of said electric motors (21) is a brushless motor.

5. The loom as claimed in claim 1, wherein said loom comprises a programmable control unit (22) operatively connected with the electric motors (21) to control displacement of each movable guide (11).

6. The loom as claimed in claim 5, wherein said loom further comprises sensor means (23) connected with the programmable control unit (22) to detect at least one parameter indicating the work step of the loom (1).

7. The loom as claimed in claim 1, wherein said loom comprises motion-transmitting means (28) interposed between each electric motor (21) and the respective movable guide (11).

8. The loom as claimed in claim 7, wherein the electric motors (21) are mounted on an upper portion (24) of the supporting structure (2).

9. The loom as claimed in claim 7, wherein the motion-transmitting means (28) comprises an intermediate kinematic mechanism (29) connected with the electric motor (21), and a flexible element (30) having a first end (30*a*) connected with one of said movable guides (11) and a second end (30*b*) connected with the intermediate kinematic mechanism (29).

10. The loom as claimed in claim 9, wherein the intermediate kinematic mechanism (29) comprises a crank (32) fitted on a small shaft (26) of the electric motor (21); a connecting-rod (33) having a first end (33*a*) pivotally mounted on the crank (32); a rocker arm (34) connected with the second end (30*b*) of the flexible element (30) and with a second end (33*b*) of the connecting-rod (33).

11. The loom as claimed in claim 10, wherein the rocker arm (34) has a first end (34*a*) articulated on the second end (33*b*) of the connecting-rod (33), a second end (34*b*) connected with the second end (30*b*) of the flexible element (30) and a third end (34*c*) articulated on the upper portion (24) of the supporting structure (2).

12. The loom as claimed in claim 1, wherein said loom further comprises at least one auxiliary movable guide (39) for a respective auxiliary warp thread (Oa), and auxiliary actuating means (40) for said auxiliary guide (39), to move said auxiliary guide (39) in a manner independent of the heddle frames (6).

13. The loom as claimed in claim 12, wherein the auxiliary actuating means (40) comprises at least one auxiliary electric motor (41) and at least one intermediate mechanical driving mechanism (42) for connection of said auxiliary electric motor (41) with said at least one auxiliary guide (39).

14. The loom as claimed in claim 13, wherein said loom comprises a plurality of forming heads (3), each of said electric motors (21) is connected with the homologous movable guides (11) of all heads (3) and said at least one auxiliary electric motor (41) is connected with the homologous auxiliary guides (39) of all heads (3).

15. The loom as claimed in claim 13, wherein said at least one auxiliary electric motor (41) is of the same type as the electric motors (21) connected with the movable guides (11) for the weft threads (T).

16. The loom as claimed in claim 13, wherein said loom comprises a programmable control unit (22) operatively connected with the electric motors (21) to control displacement of each movable guide (11) and said at least one auxiliary electric motor (41) is connected with the programmable control unit (22).

17. The loom as claimed in claim 13, wherein the intermediate mechanical driving mechanism (42) for connection comprises a flexible element (46) having one end (46*a*) connected with the auxiliary electric motor (41) and a second end (46*b*) connected with an upper end (39*a*) of the auxiliary movable guide (39).

18. The loom as claimed in claim 13, wherein the intermediate mechanical driving mechanism (42) for connection further comprises an idle pulley (43) mounted on the supporting structure (2) and a belt (45) passing over said pulley (43) and the small shaft (44) of the auxiliary electric motor (41); the first end (46*a*) of the flexible element (46) being hooked on the pulley (43).

19. The loom as claimed in claim 1, wherein said loom further comprises means (10) for feeding said at least two weft threads (T) positioned upstream of the forming head (3).

20. The loom as claimed in claim 19, wherein the feeding means (10) comprises at least two secondary electric motors (48), connected each with a pulley (49) dedicated to a respective movable guide (11) and on which a weft thread (T) is engaged.

21. The loom as claimed in claim 20, wherein said loom comprises a plurality of forming heads (3), each of said electric motors (21) is connected with the homologous movable guides (11) of all heads (3) and each of said secondary electric motors (48) is connected with a plurality of pulleys (49) dedicated to the homologous movable guides (11) of all heads (3).

22. The loom as claimed in claim 20, wherein said at least two secondary electric motors (48) are of the same type as the electric motors (21) connected with the movable guides (11).

23. The loom as claimed in claim 20, wherein said loom comprises a programmable control unit (22) operatively connected with the electric motors (21) to control displacement of each movable guide (11) and said at least two secondary electric motors (48) are connected with the programmable control unit (22).

24. The loom as claimed in claim 20, wherein the secondary electric motors (48) are installed in a rear portion (47) of the supporting structure (2).

25. The loom as claimed in claim 22, wherein said loom comprises at least two motion-transmitting members (51), each of them being interposed between a secondary electric motor (48) and a respective pulley (49).

26. The loom as claimed in claim 24, wherein each of said at least two motion-transmitting members (51) comprises a belt (53) passing over a small shaft (52) of a respective secondary electric motor (48) and on a propeller shaft (50) carrying the pulley (49).

27. A textile product obtained with a needle loom as claimed in claim 1.

* * * * *